US007695315B2

(12) United States Patent
Hitchcock et al.

(10) Patent No.: US 7,695,315 B2
(45) Date of Patent: Apr. 13, 2010

(54) STACKED ELECTRICAL CONNECTOR WITH TERMINAL ASSURANCE MECHANISM

(75) Inventors: Matthew Bryan Hitchcock, Harrisburg, PA (US); James Edward Gundermann, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/940,596

(22) Filed: Nov. 15, 2007

(65) Prior Publication Data

US 2008/0119084 A1 May 22, 2008

Related U.S. Application Data

(60) Provisional application No. 60/860,250, filed on Nov. 20, 2006.

(51) Int. Cl.
*H01R 13/60* (2006.01)

(52) U.S. Cl. ..... 439/541.5; 439/595; 439/752; 439/701

(58) Field of Classification Search ..... 439/595, 439/596, 597, 541.5, 686, 687, 688, 701, 439/717, 744, 752, 752.5
See application file for complete search history.

(56) References Cited

U.S. PATENT DOCUMENTS 4,368,939 A * 1/1983 Foederer ..... 439/594
5,201,674 A * 4/1993 Okura ..... 439/595
5,203,722 A 4/1993 Kinoshita
5,288,251 A * 2/1994 Sumida ..... 439/701
5,769,670 A * 6/1998 Abe ..... 439/752
5,890,933 A * 4/1999 Okabe ..... 439/701
6,296,530 B1 * 10/2001 Yoneda et al. ..... 439/701
6,332,812 B1 * 12/2001 Kazuhara ..... 439/701
6,340,316 B2 * 1/2002 Nagai ..... 439/701
6,402,568 B1 * 6/2002 Nagai ..... 439/701
6,482,035 B2 * 11/2002 Okabe et al. ..... 439/596
6,579,129 B2 * 6/2003 Sato ..... 439/724
7,278,890 B1 10/2007 Smutny et al.
7,572,154 B2 8/2009 Ichio et al.
2001/0053631 A1 * 12/2001 Nagai ..... 439/625
2008/0119084 A1 * 5/2008 Hitchcock et al. ..... 439/541.5

* cited by examiner

*Primary Examiner*—James Harvey

(57) ABSTRACT

A stacked electrical connector formed by mating an upper and a lower housing having rows of cavities containing terminals is disclosed. The upper and lower housings have primary terminal assurance provided by lances integrally formed into the housings. A secondary terminal assurance system is provided to further secure the terminals within the housings. In one embodiment, secondary terminal assurance is to terminals in the upper housing by lower housing protrusions and to terminals in the lower housing by a hinge. In another embodiment, secondary terminal assurance is provided to terminals in the upper and lower housing by upper and lower protrusions of a lock plate.

9 Claims, 11 Drawing Sheets

STACKED ELECTRICAL CONNECTOR WITH TERMINAL ASSURANCE MECHANISM

CROSS REFERENCE TO RELATED APPLICATIONS

This application claims the priority of U.S. provisional patent application No. 60/860,250 filed Nov. 20, 2006, incorporated herein by reference in its entirety.

FIELD OF THE INVENTION

The present invention relates to electrical connectors. More specifically, the present invention relates to a stacked electrical connector.

BACKGROUND OF THE INVENTION

In several different industries and for a wide variety of applications, electrical connector designs are standardized on various different harnesses or on various different discrete ends of a particular harness. The need for standardization of electrical connectors for a particular harness design is particularly true in the automotive industry.

The electrical connectors for these harness assemblies have been proposed having various features to afford a secure mechanical and electrical engagement with a mating electrical connector or other mateable connecting device. In many applications, the connector includes numerous electrical terminals or contacts. Often, these connectors include housings having rows of terminal cavities. The housings are stacked together to form the connector. In some connectors, the terminals may be assembled into each housing before the housings are assembled together to build the connector. One problem with this type of connector is that the assembled connector must be constructed to a high degree of precision to assure proper alignment with a mating connector. Additionally, the proper installation of each terminal within a corresponding cavity in each housing must be assured.

Therefore, there is an unmet need to provide a stacked electrical connector with a terminal assurance mechanism that provides for a precise loading of terminals within cavities of the each connector housing and that includes features assuring a precise mating of each housing forming the connector.

SUMMARY OF THE INVENTION

In a first exemplary embodiment of the invention, an electrical connector is disclosed that includes an upper housing comprising cavities configured to receive electrical terminals and upper housing lances integrally formed into the upper housing for providing primary terminal assurance to the terminals received in the cavities in the upper housing, a lower housing configured to be mated to the upper housing to form the electrical connector, the lower housing comprising cavities configured to receive electrical terminals and lower housing lances integrally formed into the lower housing for providing primary terminal assurance to terminals received in the lower housing, and a secondary terminal assurance system configured to provide secondary terminal assurance to terminals received in the lower housing. The upper and lower lances are configured to secure terminals received in the upper and lower housings, respectively, from moving.

In one exemplary embodiment of the connector, the secondary terminal assurance system includes a hinge configured to secure terminals received in the lower housing from moving when the hinge is locked into the lower housing. The hinge is attached to the lower housing at a pivot area that allows the hinge to partially rotate with respect to the lower housing about the pivot area prior to locking with into the lower housing. The hinge includes a hook configured to engage the terminals received in the cavities of the lower housing. The hook is further configured to engage a ledge in the lower housing to lock the hinge at a fixed locked position with the lower housing. The secondary terminal assurance system of this embodiment further includes wedges disposed on a top surface of the lower housing which are configured to secure terminals received in the upper housing from moving when the upper and lower housings are mated.

In a second exemplary embodiment of the connector, the secondary terminal assurance system includes a lock plate. The lock plate includes lower protrusions configured to provide secondary terminal assurance to terminals received in the cavities of the lower housing when the lock plate is fully inserted into the lower housing. The lock plate further includes upper protrusions configured to provide secondary terminal assurance to terminals received in the cavities of the upper housing when the upper and lower housings are mated and the lock plate is fully inserted in the lower housing. The lock plate is detachable from the lower housing. The lock plate is configured to be partially inserted into the lower housing to allow for terminals to be loaded into the cavities of the upper and lower housings.

In another exemplary embodiment of the invention, a method of assembling an electrical connector is disclosed that includes providing an upper housing comprising cavities configured to receive and secure electrical terminals and upper housing lances configured to provide primary terminal assurance to the terminals received in the cavities in the upper housing, providing a lower housing configured to mate with the upper housing to form the electrical connector, the lower housing comprising cavities configured to receive and secure electrical terminals and lower housing lances configured to provide primary terminal assurance to terminals received in the lower housing, providing a secondary terminal assurance system configured to provide secondary terminal assurance to terminals received in the upper and lower housings, and mating the upper and lower housings to form the electrical connector.

In one exemplary embodiment of the method according to the invention, the secondary terminal assurance system includes a hinge configured to secure terminals received in the lower housing from moving when the hinge is locked into the lower housing. The hinge is attached to the lower housing at a pivot area that allows the hinge to partially rotate with respect to the lower housing about the pivot area prior to locking with into the lower housing, and wherein the hinge comprises a hook configured to engage the terminals received in the cavities of the lower housing. The secondary terminal assurance system further includes wedges disposed on a top surface of the lower housing which are configured to secure terminals received in the upper housing from moving when the upper and lower housings are mated.

In a second exemplary embodiment of the method according to the invention, the secondary terminal assurance system includes a lock plate comprising lower protrusions configured to provide secondary terminal assurance to terminals received in the cavities of the lower housing when the lock plate is fully inserted into the lower housing, and upper protrusions configured to provide secondary terminal assurance to terminals received in the cavities of the upper housing when the upper and lower housings are mated and the lock plate is fully inserted in the lower housing. The lock plate is detachable from the lower housing. Additionally, the lock plate is configured to be partially inserted into the lower housing to allow for terminals to be loaded into the cavities of the upper and lower housings.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
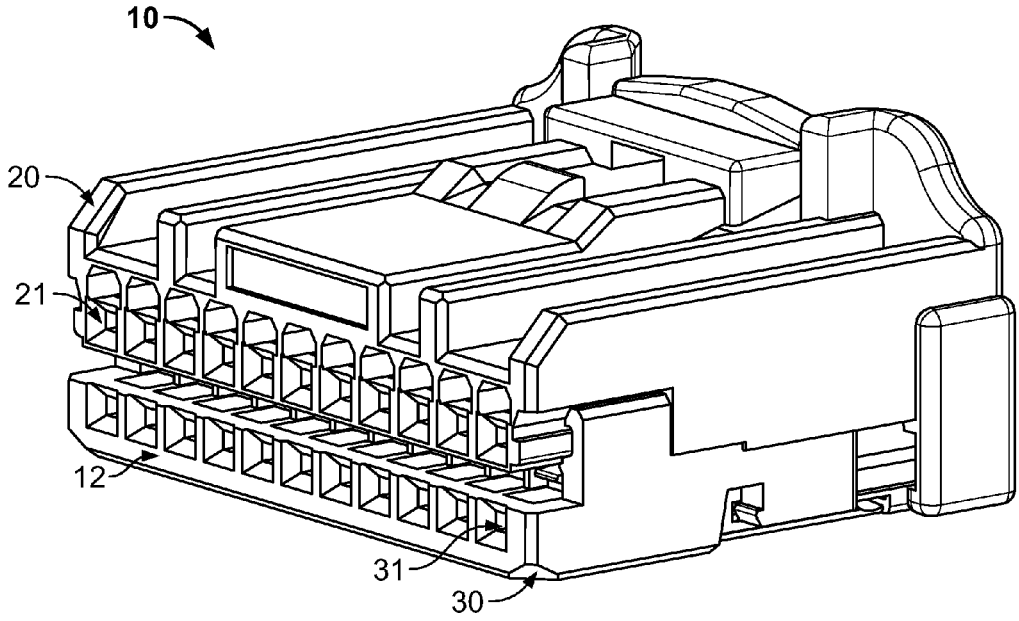
FIG. 1 illustrates a front perspective view of exemplary stacked electrical connector according to a first embodiment of the invention.
Figure 2:
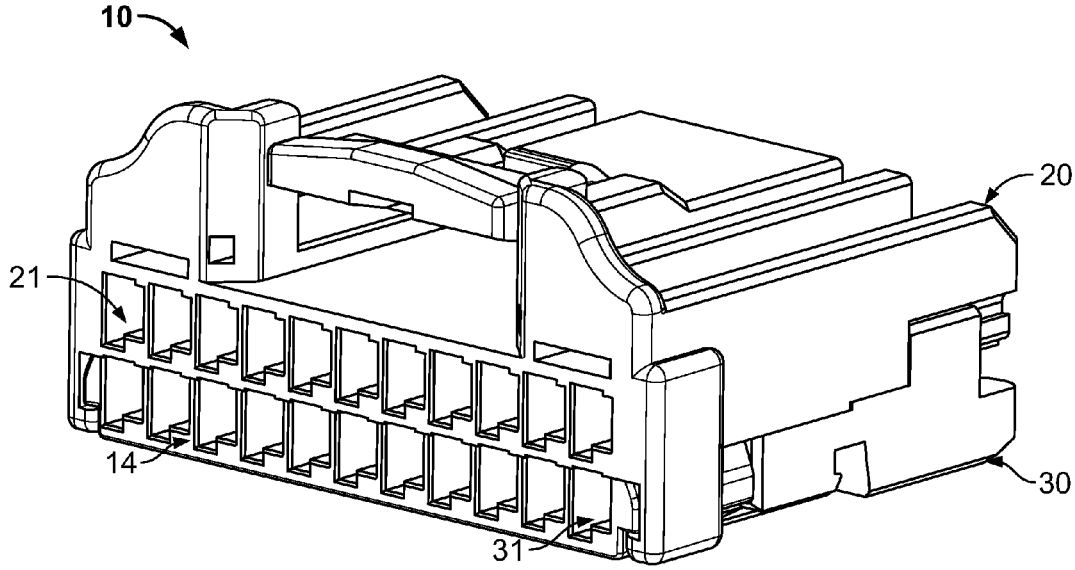
FIG. 2 illustrates a rear perspective view of an exemplary stacked electrical connector according to a first embodiment of the invention.

In an exemplary embodiment of the present invention, a stacked connector 10 including a terminal assurance mechanism for securing and aligning terminals is disclosed as shown in FIG. 1. The connector 10 includes an upper housing 20 and a lower housing 30. The upper housing 20 includes a row of upper terminal cavities 21 configured to house terminals (not shown). The lower housing 30 also includes a row of lower terminal cavities 31 configured to house terminals (not shown). The connector 10 has a front side 12. A rear view of connector 10 is shown in FIG. 2. As can be seen in FIG. 2, the connector 10 has a rear side 14.

Figure 3:
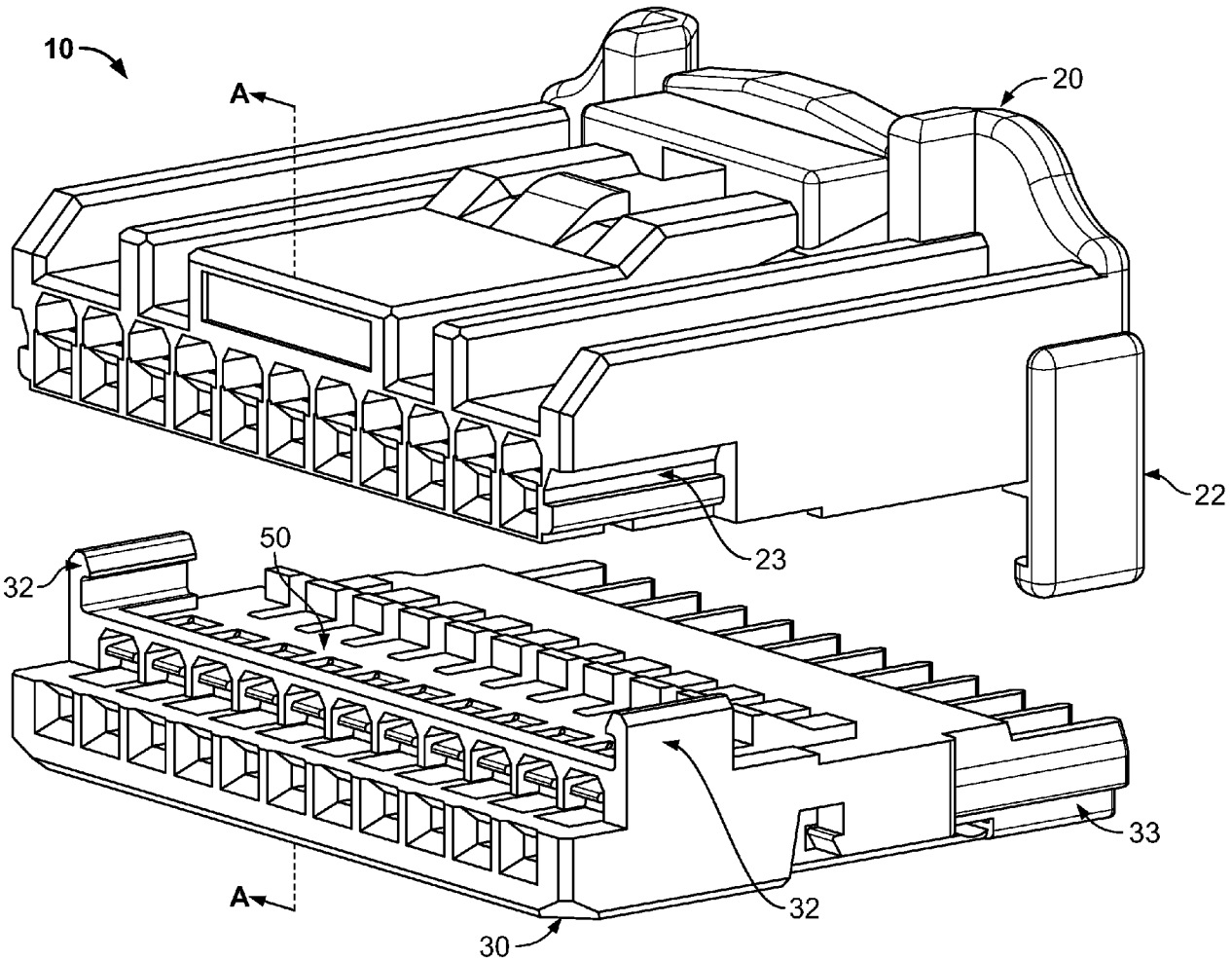
FIG. 3 illustrates an exploded view of the exemplary stacked electrical connector of FIG. 1.

An exploded view of connector 10 is shown in FIG. 3. As can be seen in FIG. 3, upper housing 20 includes upper tabs 22 (a similarly configured mating tab as seen in FIG. 3 is present, but not shown, on the opposite side of the housing 20). As can be further seen in FIG. 3, lower housing 30 includes lower tabs 32. Upper housing 20 additionally includes tab recesses 23 (a similarly configured tab recess as seen in FIG. 3 is present, but not shown, on the opposite side of the housing 20) for engaging corresponding lower tabs 32. Additionally, lower housing additionally includes lower tab recesses 33 (a similarly configured lower tab recess as seen in FIG. 3 is present, but not shown, on the opposite side of the housing 30) for engaging corresponding upper tabs 22. When the upper housing 20 and the lower housing 30 are aligned and brought into contact as shown in FIG. 1, the upper and lower tabs 22, 32 engage corresponding tab recesses 33, 23 to lock the upper housing 20 and lower housing 30 together to form the connector 10.

Figure 4:
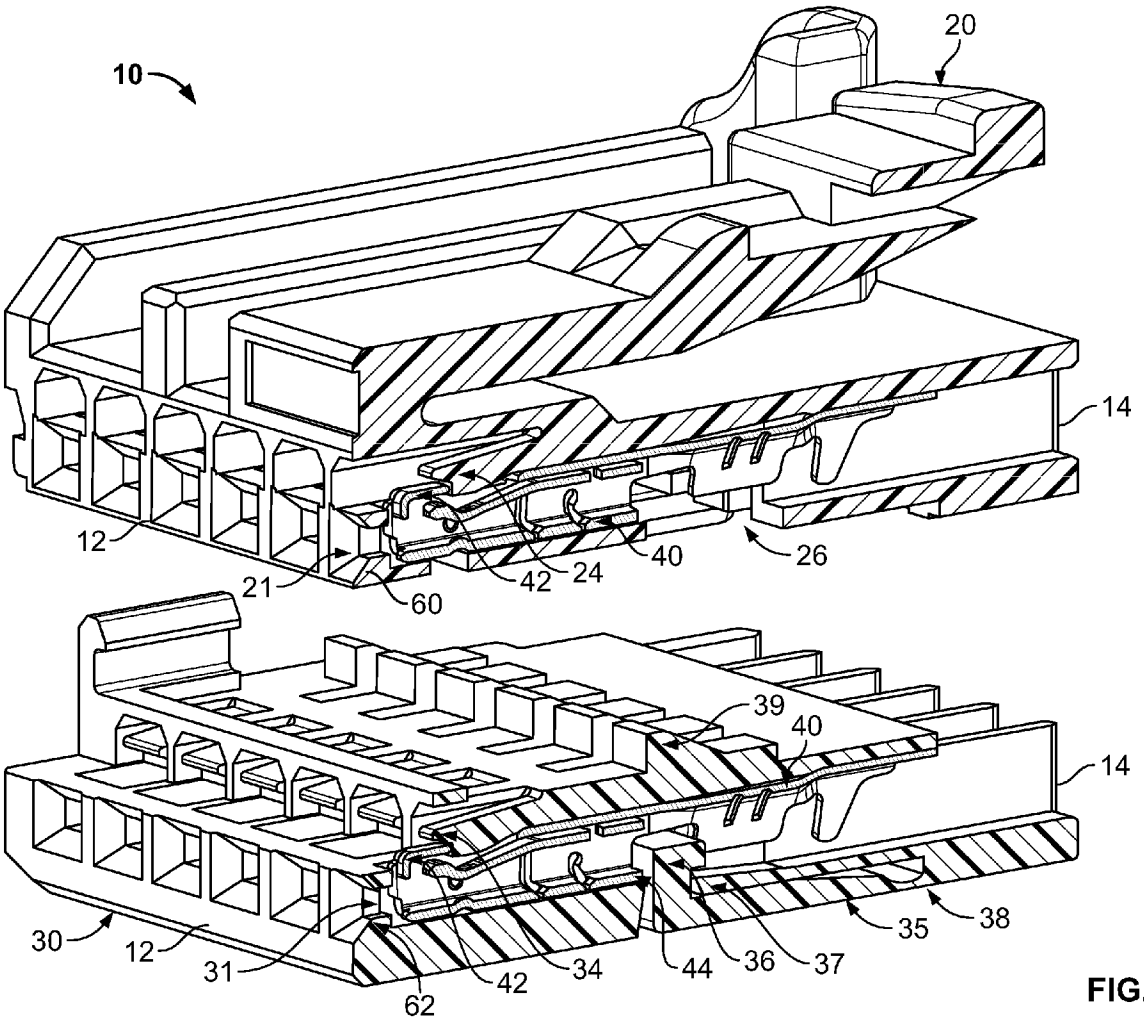
FIG. 4 illustrates a sectional view of the exploded view of the exemplary stacked electrical connector of FIG. 3 taken along line A-A.

A cross sectional view of the exploded view of connector 10 from FIG. 3 taken along line A-A is shown in FIG. 4. As can be seen in FIG. 4, upper cavities 21 and lower cavities 31 contain terminals 40. The terminals 40 are configured to be secured within the cavities 21, 31 as shown. In this exemplary embodiment, the terminals 40 are clean body terminals having two locking points.

The primary terminal assurance is provided to the terminals 40 in the upper housing 20 by upper housing lances 24, and the primary terminal assurance is provided to the terminals 40 in the lower housing 30 by lower housing lances 34. The lances 24, 34 protrude into their respective cavities 21, 31 to engage their respective terminals 40 behind a terminal front section 42 and prevent the terminals 40 from being moved towards the rear side 14 of connector 10. As can be seen in FIG. 4, the lances 24, 34 are integrally formed with their respective housings 20, 30. As can be further seen in FIG. 4, the leading sections 42 of terminals 40 float or have minimal movement between the lances 24, 34 and the upper and lower housing cavity front sections 60, 62.

As can be additionally seen in FIG. 4, a secondary terminal assurance system is provided that includes hinge 35. Hinge 35 provides secondary terminal assurance for the terminals 40 located in the lower housing 30. Hinge 35 includes a hook 36 that engages terminals 40 when locked into the lower housing 30 as shown in FIG. 4. Hinge 35 further prevents terminals 40 located in the lower housing 30 from being moved towards the rear side 14 of the connector 10. Hook 36 prevents the lower rear edges 44 of the terminals 40 from being withdrawn towards the rear side 14 of connector 10 by engaging the edges 44 when the terminals 40 are pushed towards the rear 14 of the connector 10. Hook 36 also engages a ledge 37 in the lower housing 30 to lock the hinge 35 with the lower housing 30. Hinge 35 further includes a pivot area 38 that allows hinge 35 to partially rotate with respect to the lower housing 30 about the pivot area 38 prior to locking with or engaging the ledge 37.

As can also be seen in FIG. 4, the secondary terminal assurance system also includes wedges 39. The wedges 39 are disposed on a top surface 50 of the lower housing 30 and are integrally formed with the lower housing 30. The upper housing 20 includes secondary terminal assurance openings 26 that receive the wedges 39 when the upper housing 20 and the lower housing 30 are mated. Wedges 39 provide secondary terminal assurance to terminals 40 located in the upper housing 20 when the upper housing 20 and the lower housing 30 are mated as shown in FIG. 1. It should be understood that the geometry of the secondary terminal assurance mechanism need not be wedge shaped, and that other shapes that provide an engaging surface to the terminals, such as blocks may be used.

Figure 5:
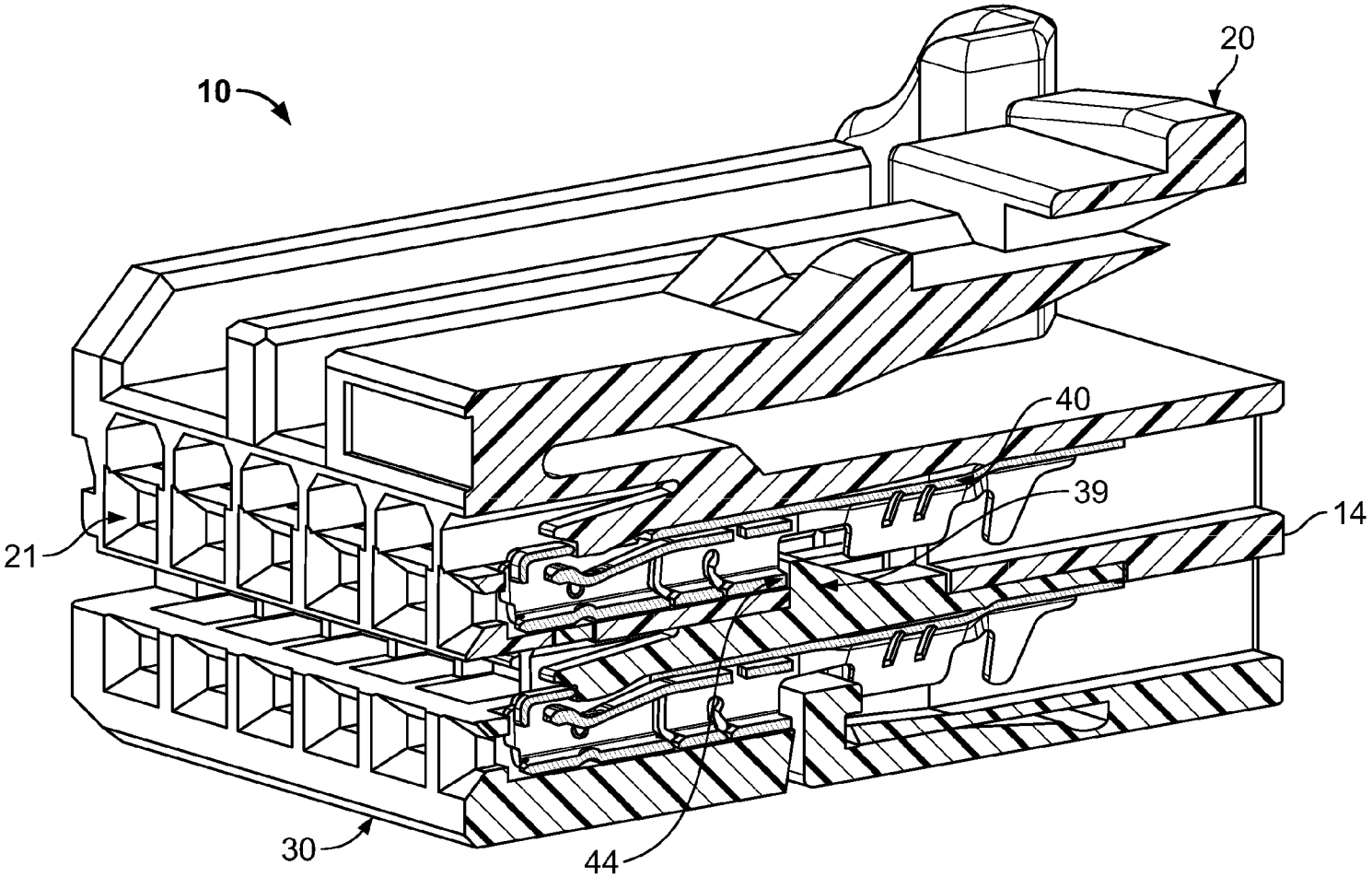
FIG. 5 illustrates a sectional view of the view of the exemplary stacked electrical connector of FIG. 3 taken along line A-A after mating.

A sectional view taken along line A-A of FIG. 3, after the upper and lower housings 20, 30 have been mated, is shown in FIG. 5. As can be seen in FIG. 5, secondary assurance is provided to the terminals 40 located in the upper housing 20 by wedges 39. The wedges 39 prevent the terminals 40 from being withdrawn towards the rear side 14 of the connector 10 by engaging the lower rear edges 44 of the terminals 40 when the terminals 40 are pushed towards the rear side 14 of the connector 10. Additionally, the wedges 39 prevent the terminals 40 from being fully inserted in the upper housing 20 if the upper and lower housings 20, 30 are mated prior to the terminals 40 being loaded into the upper housing 20. Also, if a terminal 40 is not fully inserted in a cavity 21, for example by being only partially inserted, a wedge 39 will improperly contact the partially inserted terminal 40 and prevent the upper and lower housings 20, 30 from being mated. This feature provides a check of correct loading of all terminals 40 in the upper housing 20.

Figure 6:
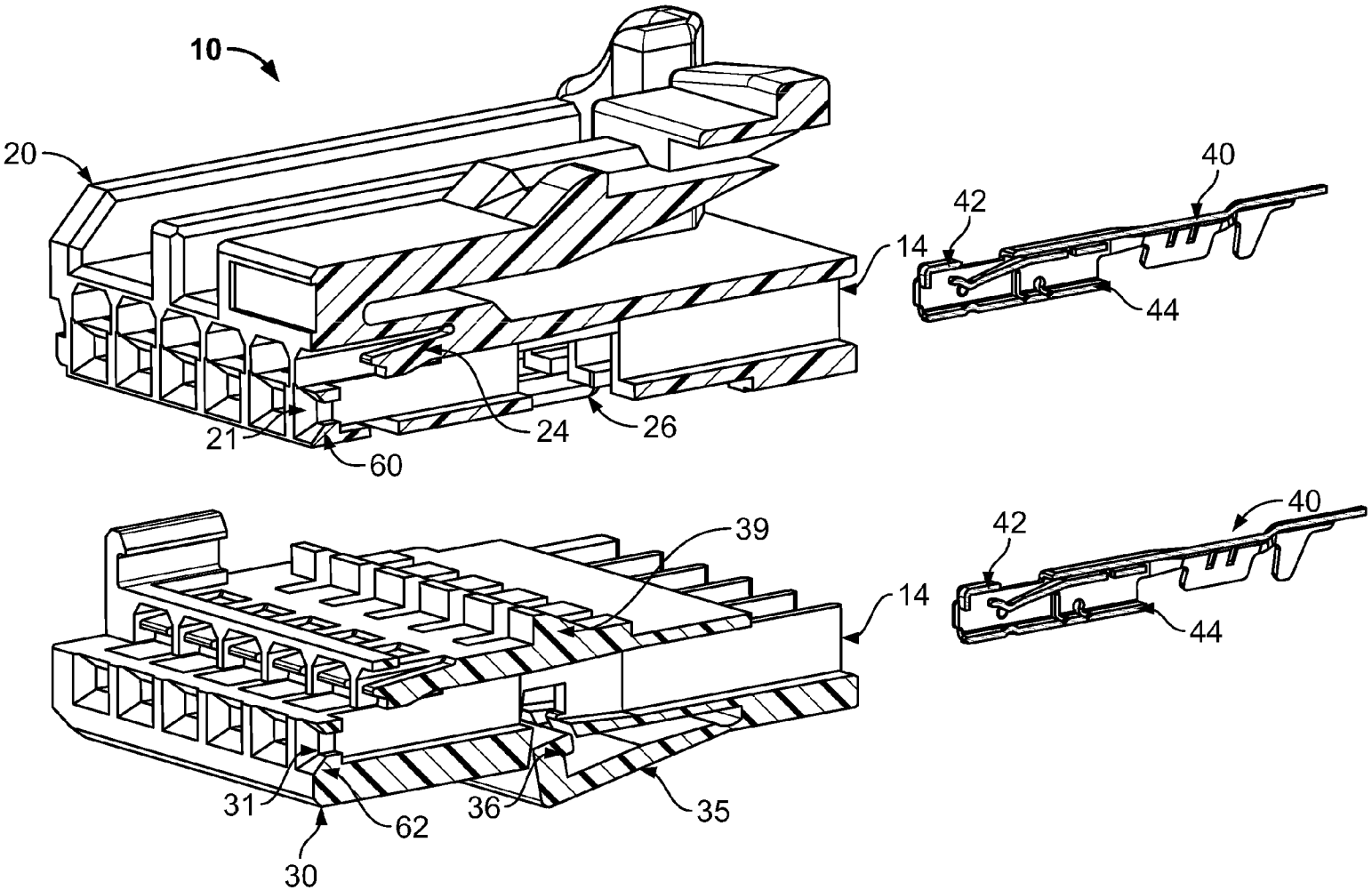
FIG. 6 illustrates a sectional view of the exploded view of the exemplary stacked electrical connector of FIG. 3 taken along line A-A with the terminals removed.

The loading of the terminals 40 into the top and lower housings 20, 30 of connector 10 will now be explained referring to FIG. 6. FIG. 6 is taken along line A-A of FIG. 3 with terminals 40 removed and positioned to be loaded into the upper and lower housings 20, 30 from the rear side 14 of the connector 10. It can be appreciated that the loading of the terminals 40 into the upper and lower housings 20, 30 may take place at different times, and even at different physical locations, prior to final assembly of the connector 10 by mating the loaded upper and lower housings 20, 30.

Terminals 40 are loaded into the upper housing 20 prior to the upper and lower housings 20, 30 being mated. The terminals 40 must be fully inserted in the upper housing 20 before the wedges 39 are received in the opening 26 of the upper housing 20 during mating. The terminals 40 are inserted into the upper cavities 21 from the rear side 14 of the connector 10. To be fully inserted, the terminals 40 are inserted into the cavities 21 until the front leading sections 42 of the terminals push passed lances 24, and the lances 24 drop behind the leading sections 42. The lances 24 are sufficiently compliant to allow the front leading sections 42 to pass.

As can be further seen in FIG. 6, terminals 40 are loaded into the lower housing 30 prior to the hinge 35 being locked with the lower housing 30. If the hinge 35 is locked with the lower housing 30 prior to the terminals 40 being received in the lower housing, the hook 36 will prevent the terminals 40 from being fully received in the lower housing cavities 31. Additionally, the terminals 40 must be fully inserted in the cavities 31 before the hinge 35 can be locked into the lower housing 30. If a terminal is not fully inserted in a cavity 31, for example by being only partially inserted into a cavity 31, the hook 36 will improperly contact the partially received terminal 40 and prevent the hinge 35 from locking into the lower housing 30. This feature provides a check of correct loading of all terminals 40 in the lower housing 30.

Figure 7:
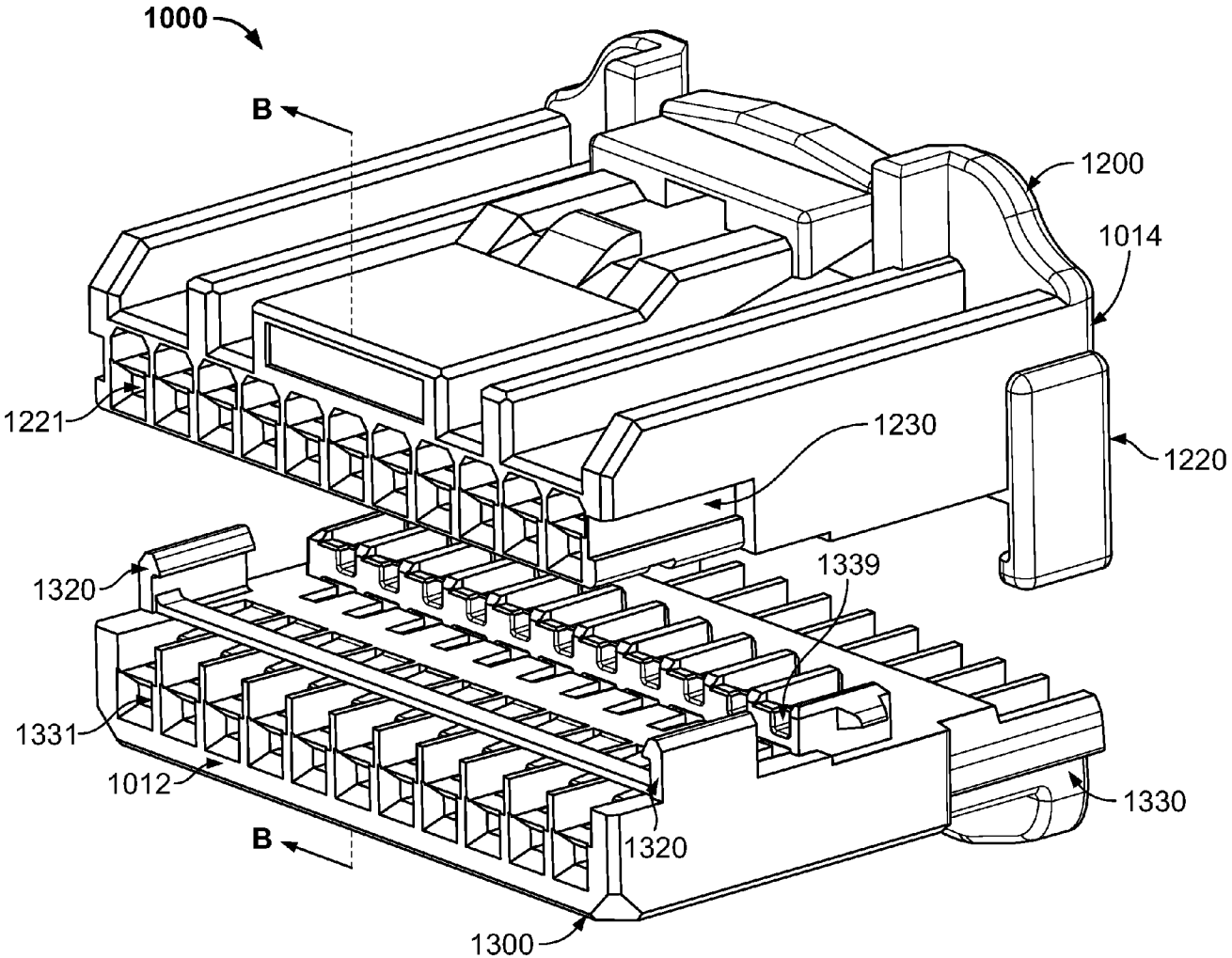
FIG. 7 illustrates an exploded view of an exemplary stacked electrical connector according to a second embodiment of the invention.

FIG. 7 shows an exploded view of an alternative embodiment of a connector 1000 having an alternative secondary locking mechanism. Connector 1000 includes an upper housing 1200, a lower housing 1300 and a lock plate 1335. Upper and lower housings 1200, 1300 include upper and lower terminal cavities 1221, 1331, respectively. Upper and lower cavities 1221, 1331 include terminals 40 (not shown). Lock plate 1335 includes upper protrusions 1339.

Upper housing 1200 includes upper tabs 1220 (a similarly configured mating tab as shown in FIG. 7 is present, but not shown, on the opposite side of the housing 1200). Lower housing 1300 includes lower tabs 1320. Upper housing 1200 additionally includes tab recesses 1230 (a similarly configured tab recess as seen in FIG. 7 is present, but not shown, on the opposite side of the housing 1200) for engaging corresponding lower tabs 1320. Additionally, lower housing 1300 additionally includes lower tab recesses 1330 (a similarly configured lower tab recess as seen in FIG. 7 is present, but not shown, on the opposite side of the housing 1300) for engaging corresponding upper tabs 1220. Connector 1000 has a front side 1012 and a rear side 1014.

Figure 8:
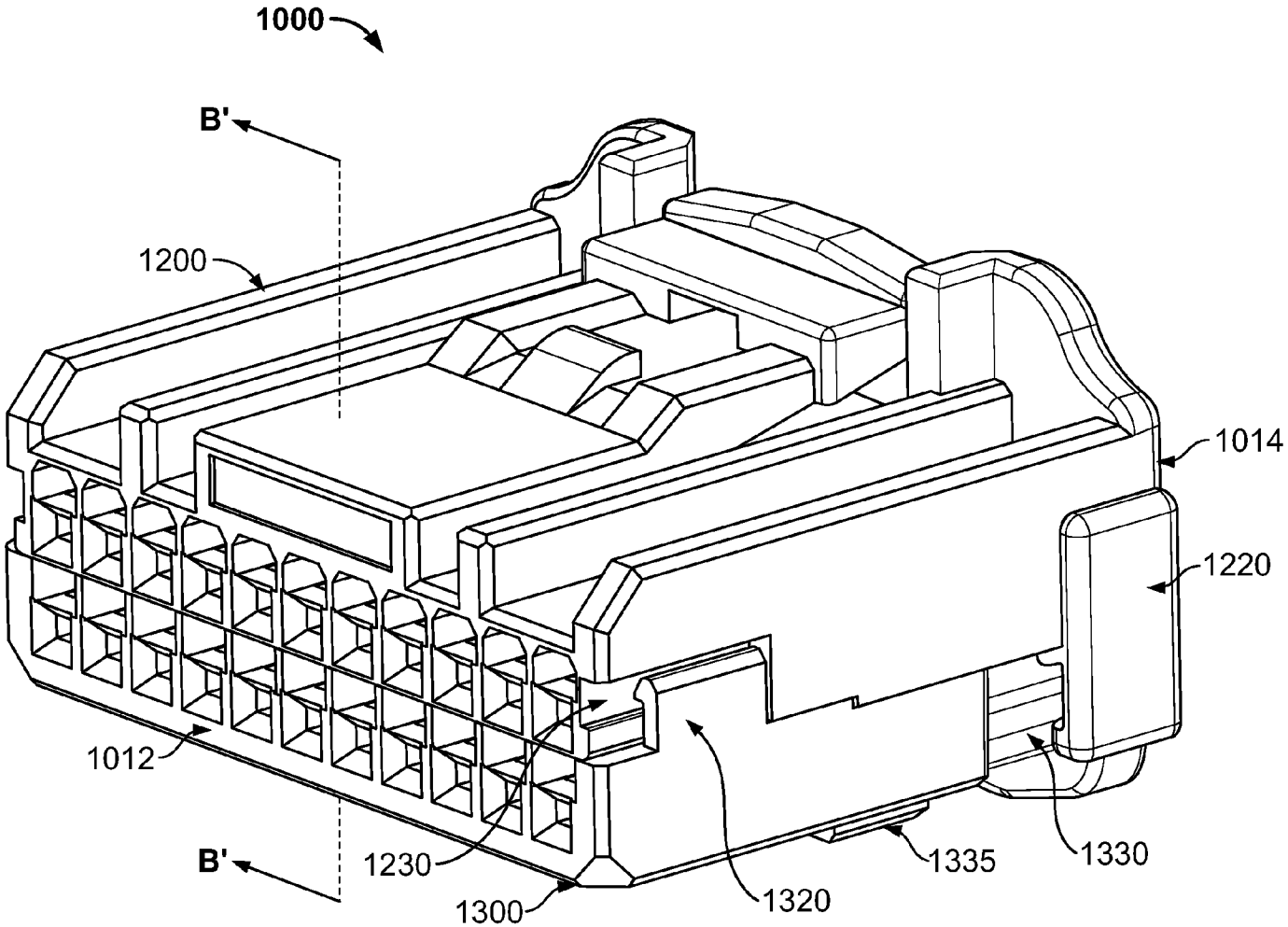
FIG. 8 illustrates a front perspective view of the exemplary stacked electrical connector of FIG. 7 after mating.

FIG. 8 shows the connector 1000 of FIG. 7 having the upper and lower housings 1200, 1300 mated. As can be seen in FIG. 8, the upper and lower tabs 1220, 1320 engage corresponding tab recesses 1330, 1230 (tabs and recesses on the opposite side not shown) to mate and form the assembled connector 1000.

Figure 9:
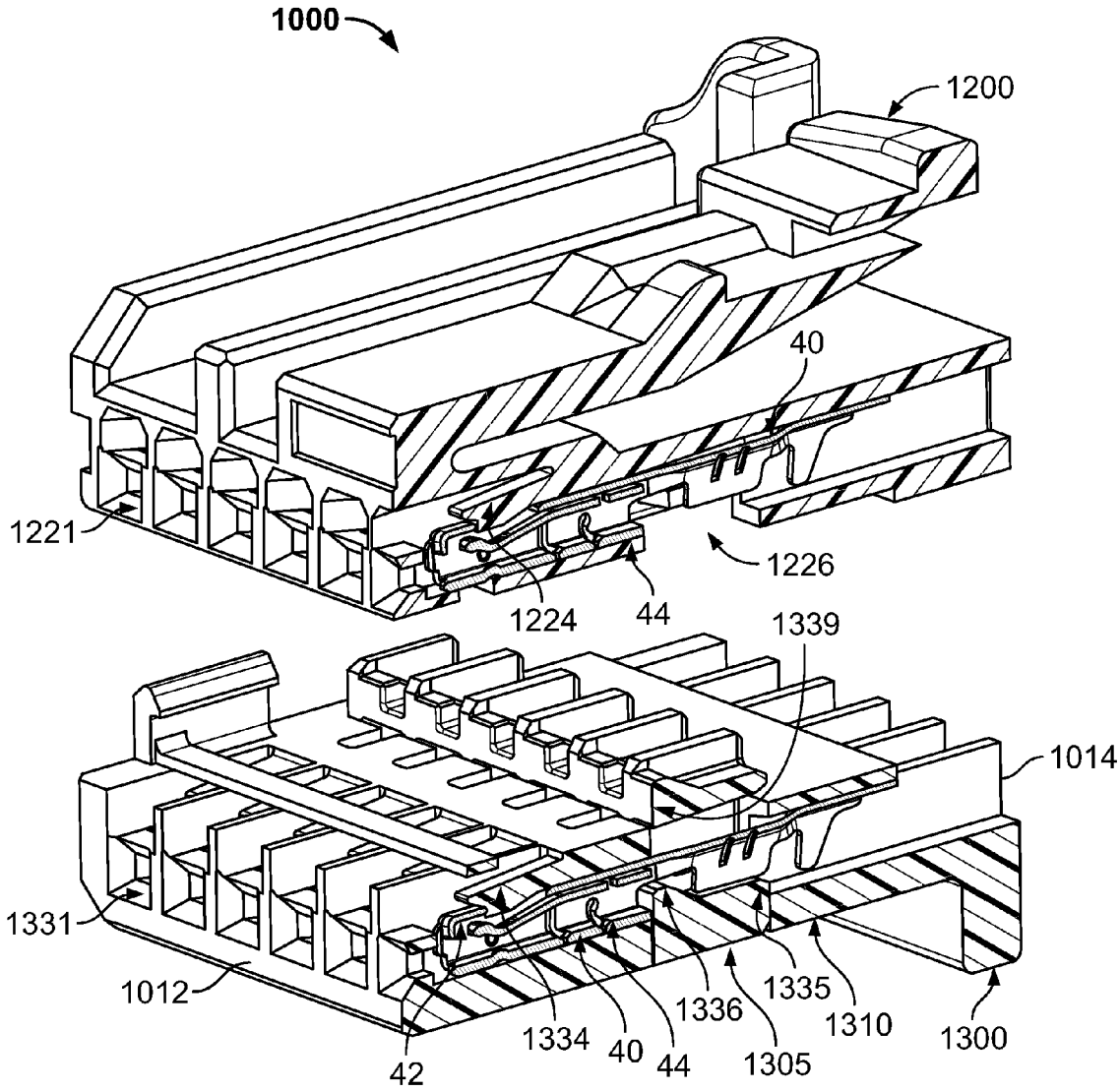
FIG. 9 illustrates a sectional view of the exploded view of the exemplary stacked electrical connector of FIG. 7 taken along line B-B.

A sectional view of the exploded view of connector 1000 taken along line B-B of FIG. 7 is shown in FIG. 9. As can be seen in FIG. 9, primary terminal assurance is provided to terminals 40 in the upper housing 1200 by upper housing lances 1224. Primary terminal assurance is provided to terminals 40 in the lower housing 1300 by lower housing lances 1334. The lances 1224, 1334 protrude into their respective cavities 1221, 1331 behind the front leading sections 42 of terminals 40 to prevent the terminals 40 from being moved towards the rear side 1014 of connector 1000. Lances 1224, 1334 are integrally formed with their respective housings 1200, 1300 as shown in FIG. 9.

The secondary terminal assurance system includes lock plate 1335. The lock plate 1335 is shown fully inserted into the lower housing 1300 in FIG. 9 to provide secondary terminal assurance to terminals 40 located in the lower housing 1300. When the lock plate 1335 is fully inserted, lower protrusions 1336 prevent the terminals 40 located in the lower housing 1300 from being withdraw from the lower cavities 1331 by engaging the lower rear edges 44 of terminals 40 when the terminals 40 are pushed towards the rear 1014 of the connector 1000. The lock plate 1335 includes tabs (not shown) for snap fitting the lock plate 1335 into the lower housing 1300. In this exemplary embodiment, the lock plate 1335 fits flushly into an opening 1305 in the lower surface 1310 of the lower housing 1300 as shown in FIG. 9. In alternative embodiments, the lock plate may protrude from the bottom surface 1310 of the lower housing 1300 and may include tabs or other structures to assist in the insertion or removal of the lock plate 1335 into the lower housing 1300.

As can be further seen in FIG. 9, when upper and lower housings 1200, 1300 are mated, the upper protrusions 1339 will be received in opening 1226 in the upper housing 1200 and provide secondary terminal assurance to the terminals 40 located in the upper housing 1200. Upper protrusions 1339 will also prevent the mating of the upper and lower housings 1200, 1300 if a terminal is not fully inserted into a cavity 1221 of the upper housing 1200 by contacting the terminal 40 and not allowing the protrusion 1339 from being fully received in the opening 1226. The secondary terminal assurance thus provides a check to the proper loading of the loaded terminals 40 in the upper housing. Similarly, the plate 1335 cannot be fully inserted and locked into the lower housing 1300 if one of the terminals 40 is not fully inserted into a cavity 1331 of the lower housing 1300. The secondary terminal assurance provided to terminals 40 in the lower housing 1300 by protrusions 1336 engaging the terminals 40 thus provides a check to the proper terminal loading in the lower housing 1300. The protrusions 1336, 1339 are shown having a wedge geometry, but other geometries including block shape, may be used to engage terminals 40.

Lock plate 1335 is completely detachable from the lower housing 1300 when no terminals 40 are present in the lower housing 1300. The lock plate 1335 is detached by withdrawing the lock plate 1335 from the bottom surface 1310 of the lower housing 1300. As can be seen in FIG. 9, if terminals 40 are present in the lower housing 1300, those terminals 40 will block the path of the upper protrusions 1339 when being withdrawn towards the opening 1305 in the bottom surface 1310 of the lower housing 1300. Thus, if any terminals 40 are present in the lower housing 1300, the lock plate 1335 cannot be withdrawn from the bottom surface 1310 of the lower housing 1300.

Figure 10:
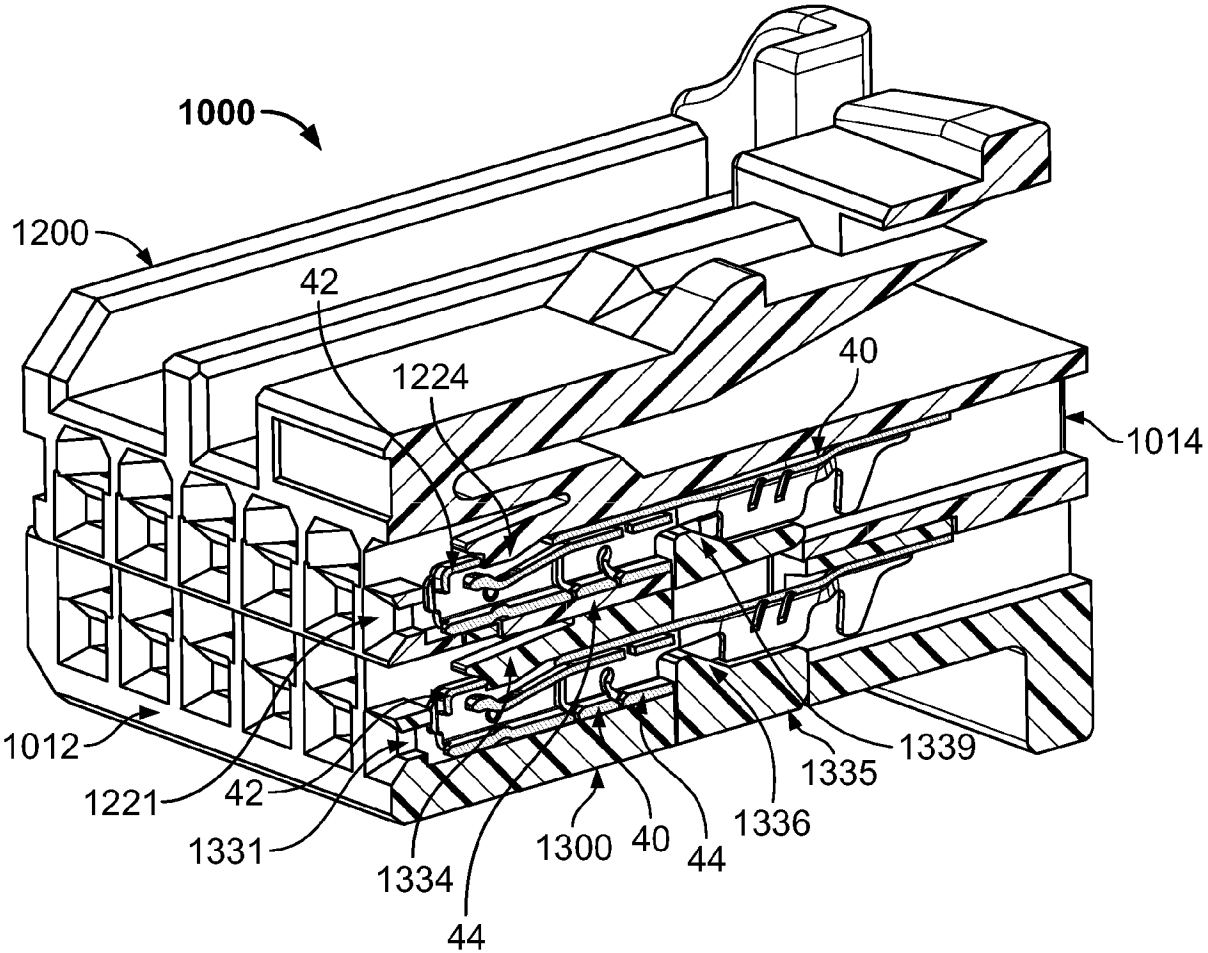
FIG. 10 illustrates a sectional view of the exploded view of the exemplary stacked electrical connector of FIG. 9 taken along line B'-B'.

FIG. 10 shows a cross sectional view of the assembled connector 1000 of FIG. 9 taken along line B'-B'. As can be seen in FIG. 10, secondary terminal assurance is provided to the terminals 40 located in the upper housing 1200 by the secondary locking mechanism, which is provided by upper protrusions 1339 of lock plate 1335. As can be seen in FIG. 9, when the lock plate 1335 is fully inserted, upper protrusions 1339 prevent the terminals 40 located in the upper housing 1200 from being withdrawn from the upper cavities 1221 by engaging the lower rear edges 44 of terminals 40 when the terminals 40 are pushed towards the rear 1014 of the connector 1000.

As can further be seen in FIG. 10, when upper and lower housings 1200, 1300 are mated and the lock plate 1335 is fully inserted, the protrusions 1336, 1339 of the lock plate 1335 prevent terminals 40 from being loaded into either or both the upper and lower housings 1200, 1300, respectively.

Figure 11:
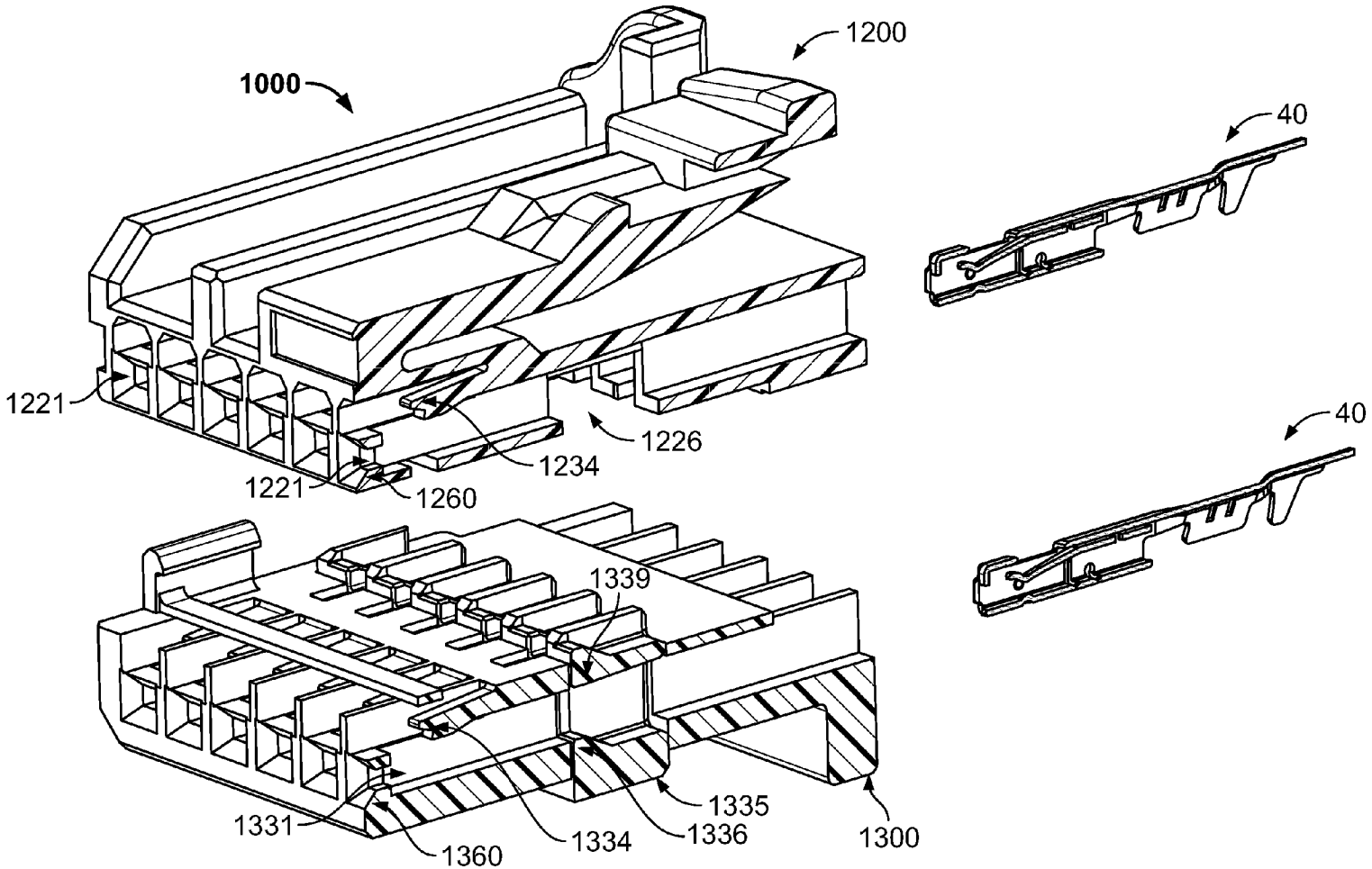
FIG. 11 illustrates the sectional view of the exemplary stacked connector of FIG. 8 with the terminals removed and with the lock plate in a pre-staged position.
Figure 12:
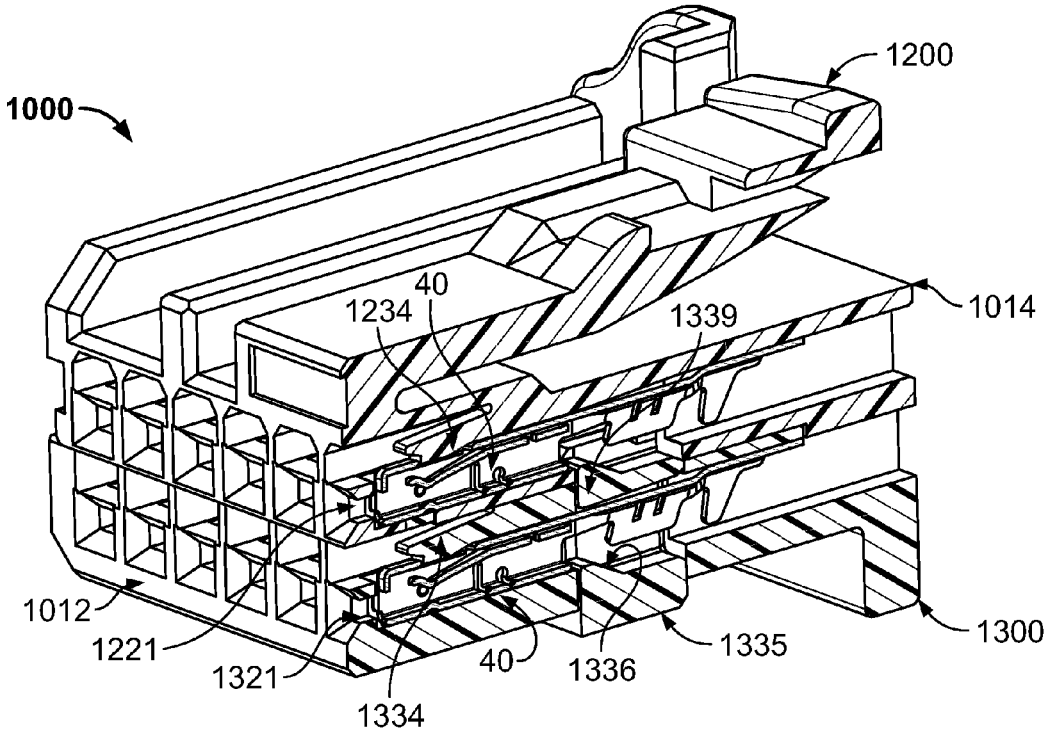
FIG. 12 illustrates the sectional view of the exemplary stacked connector of FIG. 10 with the lock plate in a pre-stated position.

An exemplary embodiment of loading of the terminals 40 into the upper and lower housings 1200, 1300 of connector 1000 is discussed referring to FIGS. 11 and 12. As can be seen in FIG. 11, the terminals 40 are loaded into the lower housing 1300 with the lock plate 1335 in a pre-staged position and with the upper and lower housings 1200, 1300 unmated. When the lock plate 1335 is in the pre-staged position, the lower protrusions 1336 are substantially flush with the cavities 1331 as shown, allowing the terminals 40 to be loaded into the cavities 1331.

The terminals 40 are loaded or inserted into the upper cavities 1221 from the rear surface 1014 of the connector 1000 as shown. To be fully inserted, the terminals 40 are inserted into the cavities 1221 until the front leading sections 42 of the terminals 40 push passed lances 1224 and the lances 1224 drop behind the leading sections 42. The lances 1224 are sufficiently compliant to allow the front leading sections 42 to pass. The terminals 40 are prevented from further forward movement by housing cavity front sections 1360. The front leading sections 42 are allowed to float, or have a predetermined minimal movement, between the lances 1334 and the front sections 1360.

The terminals 40 are loaded into the lower housing 1300 prior to the lock plate 1335 being locked into the lower housing 1300. If the lock plate 1335 is locked into the lower housing 1300 prior to the terminals 40 being received in the lower housing 1300, the protrusions 1336 will prevent the terminals 40 from being fully received in the lower housing 1300. Additionally, the terminals 40 must be fully inserted in the lower housing 1300 before the lock plate 1336 can be locked into the lower housing 1300. If a terminal is not fully inserted into the lower housing 1300, for example by being only partially inserted, the protrusions 1336 will improperly contact the partially received terminal 40 and prevent the lock plate 1335 from locking into the lower housing 1300. This feature provides a check of correct loading of all terminals 40 in the lower housing 1300. The lock plate 1335 may then be locked into the lower housing 1300 to secure the terminals 40 within the lower housing 1300, for example, prior to shipment for assembly with the upper housing 1200.

The lances 1324 provide primary terminal assurance by preventing the terminals 40 from being withdrawn from the cavities 1331. The lances 1334 engage the leading sections 42 when the terminals 40 are pushed towards the rear 1014 of the connector 1000 and prevent the terminals 40 from any further rearward movement. The housing cavity front sections 1360 prevent the terminals 40 from further forward movement towards the front side 1212 of the connector 1000.

The terminals 40 are loaded into the upper housing 1200 either prior to the lower housing 1300 with locked lock plate 1335 being mated thereto, or after mating with the lower housing 1300 but before the lock plate 1335 is locked into the lower housing 1300. The terminals 40 must be fully inserted in the upper housing 1200 before the wedges 1339 are inserted into the opening 126 in the upper housing 1200. The terminals are received into the upper cavities 1221 from the rear side 1014 of the connector 1000. To be fully inserted, the terminals 40 are inserted into the cavities 1221 until the front leading sections 42 of the terminals 40 push passed lances 1224 and the lances 1224 drop behind the leading sections 42. The lances 1224 are sufficiently compliant to allow the front leading sections 42 to pass. The terminals 40 are prevented from further forward movement by housing cavity front sections 1260. The front leading sections 42 are allowed to float, or have a predetermined minimal movement, between the lances 1234 and the front sections 1260.

The lances 1224 provide primary terminal assurance by preventing the terminals 40 from being withdrawn from the cavities 1231. The lances 1234 engage the leading sections 42 when the terminals 40 are pushed towards the rear 1014 of the connector 1000 and prevent the terminals 40 from any further rearward movement. The housing cavity front sections 1260 prevent the terminal.

FIG. 12 shows a sectional view of FIG. 11 with the terminals 40 fully inserted and the upper and lower housings 1200, 1300 mated. The lock plate 1335 is shown in a pre-staged position. The lock plate 1335 has protrusions (not shown) that engage recesses (not shown) in the lower housing 1300 that temporarily lock the lock plate 1335 into the pre-staged position. As can be seen in FIG. 12, the loaded terminals 40 in the upper and lower housings 1200, 1300 are secured by primary terminal assurance provided by the upper and lower lances 1224, 1234, respectively. In this pre-staged position, additional terminals 40 may still be loaded into unloaded upper or lower cavities 1221, 1321. Additionally, terminals 40 may be removed from the upper and lower cavities 1221, 1321 with the aid of a tool (not shown) that can be inserted into the cavities 1221, 1321 from the rear side 1014, which disengages the lances 1234, 1334 from the terminals 40 and allows the terminals 40 to be removed. After all terminals 40 have been fully inserted into the upper and lower housings 1200, 1300, the lock plate 1335 is fully inserted and secured into the lower housing 1300 to provide secondary terminal assurance to the terminals 40. The secondary terminal assurance is provided by the upper and lower protrusions 1339, 1336 of the locking plate 1335 that prohibit the terminals 40 from being moved towards the rear side 1014 of the connector 1000 as shown in FIG. 10. The lock plate 1335 includes tabs or protrusions (not shown) that engage recesses or surfaces (not shown) in or on the lower housing 1300 to secure the lock plate 1335 into a fully inserted position.

The terminals of the disclosed embodiments may be formed of a highly conductive metal or alloy or other known industry acceptable terminal or contact material. The upper and lower housings of the disclosed embodiments may be formed of known industry acceptable non-conductive polymers.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector, comprising:

an upper housing comprising cavities configured to receive electrical terminals and upper housing lances integrally formed into the upper housing for providing primary terminal assurance to the terminals received in the cavities in the upper housing;

a lower housing configured to be mated to the upper housing to form the electrical connector, the lower housing comprising cavities configured to receive electrical terminals and lower housing lances integrally formed into the lower housing for providing primary terminal assurance to terminals received in the lower housing; and a secondary terminal assurance system configured to provide secondary terminal assurance to terminals received in the lower housing;

wherein the secondary terminal assurance system comprises a hinge configured to secure terminals received in the lower housing from moving when the hinge is locked into the lower housing.

2. A method of assembling an electrical connector comprising:

providing an upper housing comprising cavities configured to receive and secure electrical terminals and upper housing lances configured to provide primary terminal assurance to the terminals received in the cavities in the upper housing;

providing a lower housing configured to mate with the upper housing to form the electrical connector, the lower housing comprising cavities configured to receive and secure electrical terminals and lower housing lances configured to provide primary terminal assurance to terminals received in the lower housing;

providing a secondary terminal assurance system configured to provide secondary terminal assurance to terminals received in the upper and lower housings; and mating the upper and lower housings to form the electrical connector;

wherein the secondary terminal assurance system comprises a hinge configured to secure terminals received in the lower housing from moving when the hinge is locked into the lower housing.

3. The connector of claim 1, wherein the hinge is attached to the lower housing at a pivot area that allows the hinge to partially rotate with respect to the lower housing about the pivot area prior to locking with into the lower housing.

4. The connector of claim 1, wherein the hinge comprises a hook configured to engage the terminals received in the cavities of the lower housing.

5. The connector of claim 4, wherein the hook is further configured to engage a ledge in the lower housing to lock the hinge at a fixed locked position with the lower housing.

6. The connector of claim 1, wherein the secondary terminal assurance system further comprises wedges disposed on a top surface of the lower housing which are configured to secure terminals received in the upper housing from moving when the upper and lower housings are mated.

7. The connector of claim 1, wherein the upper and lower lances are configured to secure terminals received in the upper and lower housings, respectively, from moving.

8. The method of claim 2, wherein the hinge is attached to the lower housing at a pivot area that allows the hinge to partially rotate with respect to the lower housing about the pivot area prior to locking with into the lower housing, and wherein the hinge comprises a hook configured to engage the terminals received in the cavities of the lower housing.

9. The method of claim 2, wherein the secondary terminal assurance system further comprises wedges disposed on a top surface of the lower housing which are configured to secure terminals received in the upper housing from moving when the upper and lower housings are mated.

* * * * *